United States Patent [19]

Stewart

[11] Patent Number: 4,964,488

[45] Date of Patent: Oct. 23, 1990

[54] LADDER STABILIZER

[76] Inventor: John V. Stewart, 1308 Henry Balch Dr., Orlando, Fla. 32810

[21] Appl. No.: 297,695

[22] Filed: Jan. 13, 1989

[51] Int. Cl.[5] ..... E04C 5/36

[52] U.S. Cl. ..... 182/172; 182/107

[58] Field of Search ..... 182/172, 170, 165, 177, 182/108, 107

[56] References Cited

U.S. PATENT DOCUMENTS

| | | | |
|---|---|---|---|
| 346,437 | 7/1886 | Geissinger | 182/172 |
| 1,135,763 | 4/1915 | Caronia | 182/172 |
| 3,395,776 | 8/1968 | Russell | 182/172 |

*Primary Examiner*—Reinaldo P. Machado

[57] ABSTRACT

A ladder stabilizer comprising rigid wings attached to the rails, extending to the ground on each side to brace the ladder. The wings are attached by hinges to fold against the ladder front for storage. The design takes advantage of the angular relationship between the rails of a ladder and the ground, to automatically adjust to the optimum angle and position of support, making deployment trivial. The design distributes stress along each ladder rail, allowing installation on portable ladders of all constructions load ratings.

Embodiments and enhancements are described which provide flexibility of use in obstructed situations, and enable user adaptability for all shapes and sizes of portable ladders.

6 Claims, 4 Drawing Sheets

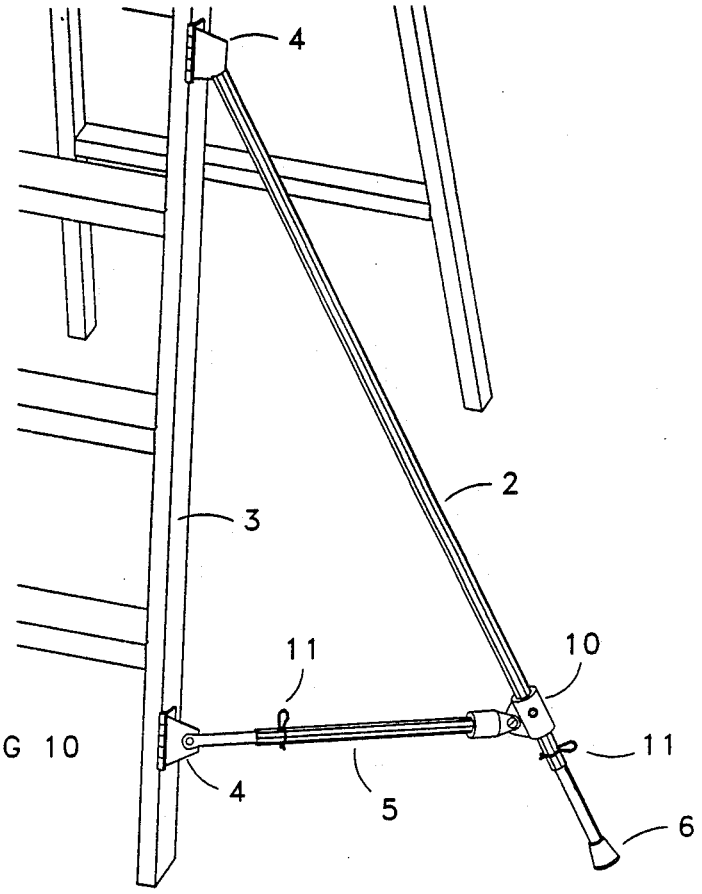
FIG 10
FIG 11
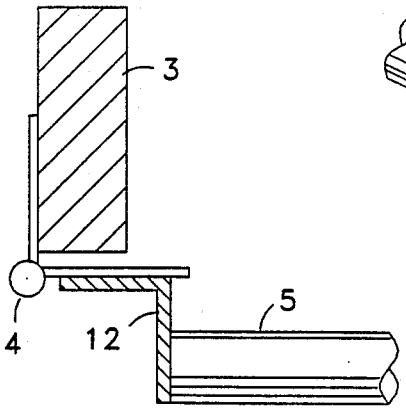
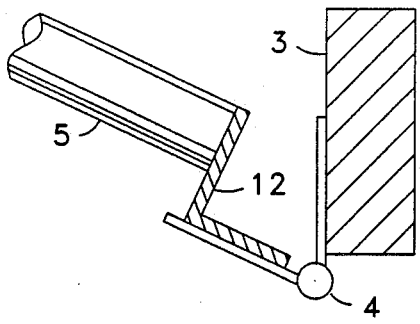
FIG 12

LADDER STABILIZER

BACKGROUND

1. Field of Invention

This invention relates to portable ladders, and to stabilizing means thereof.

2. Prior Art

Portable ladders are so unstable in use that the assistance of a second person is often advisable for steadying them. A stabilizing apparatus would be of interest to many ladder owners, but only if it were convenient and inexpensive. Safety devices of this nature must be nearly trivial to use, or they will be underutilized. A well-known example is the automobile seat belt, the utilization of which has been improved via automatic adjustment and deployment features. This suggests that, to be practical, a ladder stabilizer must be very convenient and unobstrusive, and not require adjustment on each deployment.

An improvement in portable ladders is the availablility of reconfigurable scaffold/ladder devices. These can be configured as a step ladder, straight ladder, or scaffold. However, other than providing the most appropriate ladder type for the job, they do not solve the stability problem, and they have disadvantages: they are more complicated to use than plain ladders, requiring learning of the reconfiguration operations; and they waste an investment in existing ladders, since they replace, rather than enhance existing equipment.

A stabilizer bar has been reported which attaches to the rails of a ladder, but it appears to require adjustment or reattachment for each use, and adjustment or removal for each movement of the ladder and for transport and storage, thus it lacks convenience. Also it exerts leveraged stress at a single position on each rail. This concentration of stress may restrict its safe use to ladders with exceptionally strong rails, stronger than those on most aluminum ladders.

OBJECTS AND ADVANTAGES

The primary object is a ladder stabilizer which is very convenient to use. Deployment of the device should be trivial, not even requiring adjustment. In addition, it should be inexpensive, and installable on any existing portable ladder.

The present invention fully achieves these objectives. By taking advantage of the universal angular relationship between the rails of a ladder and the surface on which the ladder stands, the device self-adjusts to the optimum angle and position of support, making deployment trivial. The design distributes stress along each ladder rail, allowing installation on ladders of all constructions and load ratings. Embodiments and enhancements are described which provide flexibility of use in obstructed situations, and enable user adaptability for all shapes and sizes of portable ladders.

DRAWING FIGURES

Figure 1:
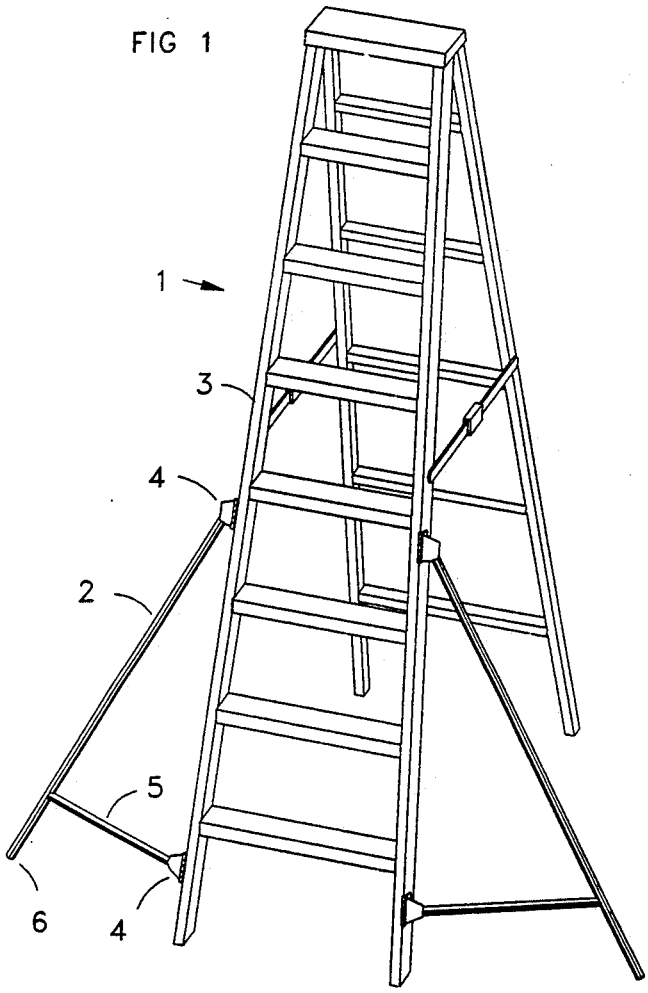

FIG. 1 Ladder with deployed stabilizers

Figure 2:
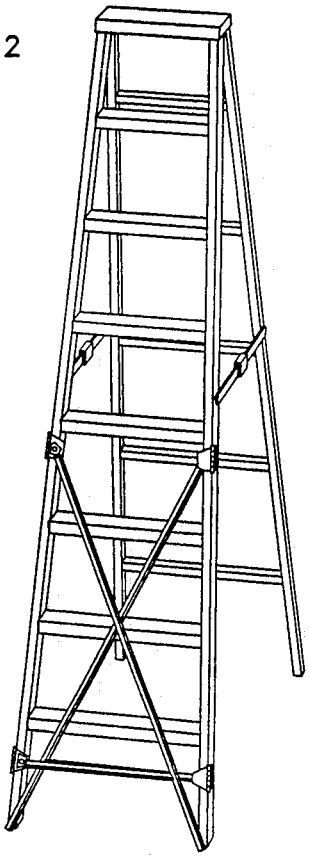

FIG. 2 Folded stabilizers

Figure 3:
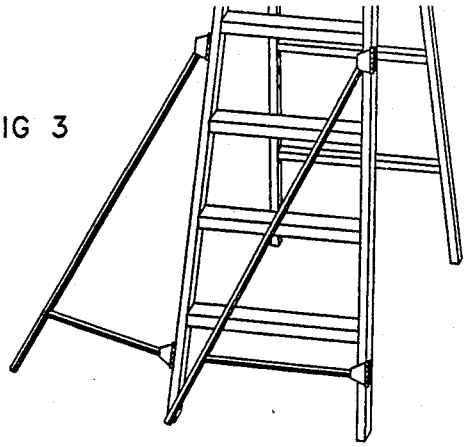

FIG. 3 One side deployed, as when the other side is obstructed

Figure 4:
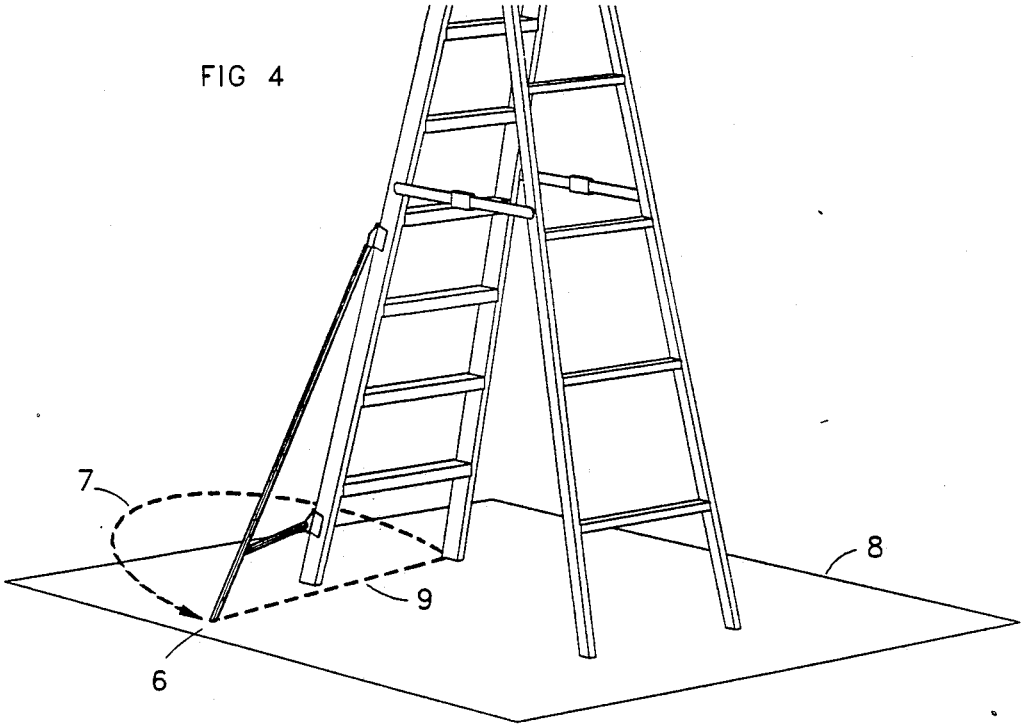

FIG. 4 Illustration of self-adjustment geometry

Figure 5:
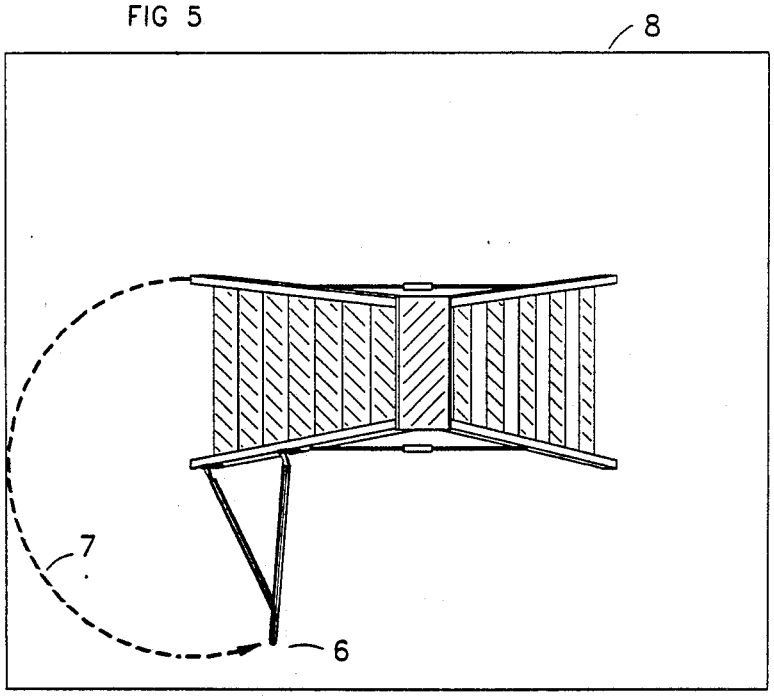

FIG. 5 Top view of FIG. 4

Figure 6:
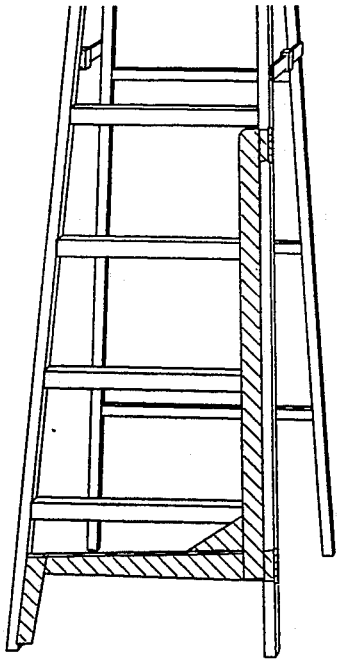

FIG. 6 Embodiment 2, folded (only one stabilizer shown)

Figure 7:
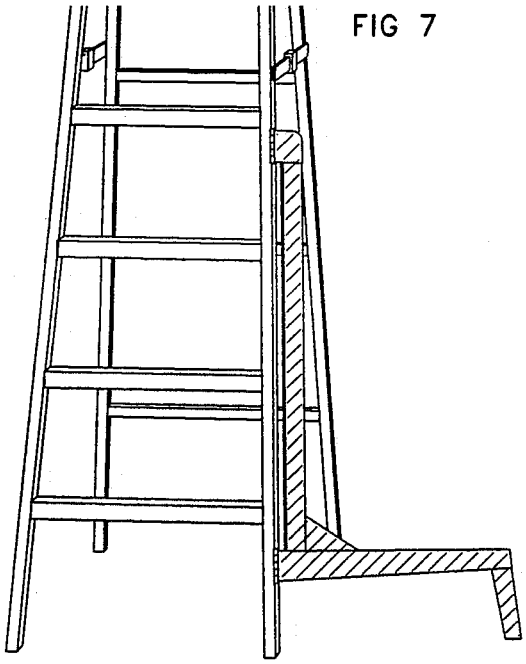

FIG. 7 Embodiment 2 deployed

Figure 8:
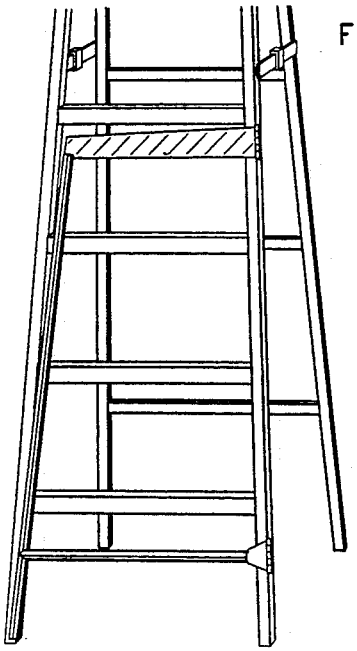

FIG. 8 Embodiment 3, folded (only one stabilizer shown)

Figure 9:
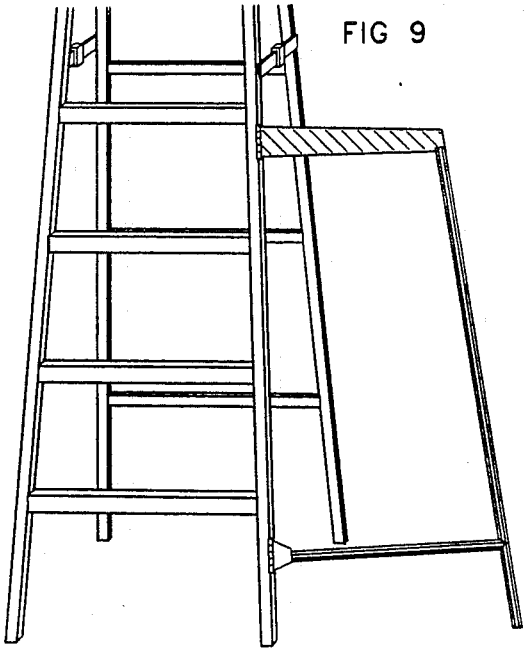

FIG. 9 Embodiment 3 deployed

FIG. 10 Stabilizer enhancements

FIG. 11 Top view of hinge with offset mount, folded position

FIG. 12 Top view of hinge with offset mount, deployed position

DRAWING REFERENCE NUMERALS:

1 Portable ladder
2 Stabilizer brace
3 Ladder rail
4 Hinge
5 Stabilizer arm
6 Stabilizer foot
7 Arc of rotation of stabilizer foot
8 Plane of surface on which ladder stands
9 Intersection of plane of foot rotation and plane 8
10 Swivel clamp
11 Clip pin for foot extension adjustment
12 Offset mounting bracket for hinges on one side of ladder

DESCRIPTION

FIG. 1 shows a portable step ladder with the invention installed and deployed. This embodiment comprises a brace 2 hinged to a ladder rail, and arm 5 hinged to the rail at a lower position, trussing the brace. The axes of the hinges are spaced from the rail forward and outside, so that the stabilizers can fold against the front of the ladder and rotate greater than 180 degrees from the folded position around to the side. The range of rotation should be about 230 degrees.

FIG. 2 shows two stabilizers folded against the front of the ladder. Deployment into the open position is performed simply by swinging each stabilizer to the side. No adjustment is required, since a stabilizer will rotate until it contacts the ground. It will remain in deployed position by gravity and friction, as shown in FIGS. 4 and 5.

FIG. 3 illustrates the use of only one stabilizer, when one side of the ladder is obstructed. This use is possible, but the steps are partly obstructed by the folded stabilizer. Embodiments which do not obstruct the steps are shown in FIGS. 6–9. In all embodiments, the lower hinge should be attached just below the bottom step. This prevents the lower arm of a stabilizer from obstructing a step. It is preferably to attach all hinges near a step, since the rails are most rigid at these locations.

The rotation of a stabilizer is shown in FIGS. 4 and 5. The rails of all portable ladders are angled backward in use, and the stabilizer design takes advantage of this geometry for self adjustment. The stabilizer will rotate from its folded position until its foot contacts the ground, where it will remain due to gravity and friction. The height of foot 6 above the ground in the folded position determines the angle of rotation required for it to contact the ground. The contact point can be set for an optimum support position—beside a middle or upper step. The stabilizer will automatically compensate for an uneven surface, contacting it fully on both sides without user adjustment. This self-adjustment mechanism applies to ladders with non-parallel rails, such as step ladders, as well as those with parallel rails, such as straight and extension ladders.

FIG. 10 shows enhancements which improve flexibility of use, and provide means for user adaptation to any ladder when the stabilizers are sold as user installable. Foot 6 can extend downward or retract upward to establish the desirable ground contact point. This is done via a telescoping rod which slides within brace 2 and is locked at a desired extension by clip pin 11. This enhancement also provides a convenient means to disengage a stabilizer when the ladder is used with its side obstructed. By fully retracting the foot, the stabilizer can rotate 270 degrees without contacting the ground, thus it can be fully rotated against the side of the ladder, so as not to obstruct the steps. This requires the stabilizers to have a 270 degree rotation range. Means to allow this include offsetting the hinge axes toward the side, or using long enough hinge plates or attachment brackets to clear the back of the rail when fully rotated.

For user installable kits, arm 5 should be extendable, to allow for varying ladder widths. This can be done by a lockable telescoping means. Brace 2 may be made extendable as well, to provide more flexibility in the attachment position for the upper hinge.

A swivel clamp 10 is suggested as a flexible means for connecting arm 5 to brace 2. It allows adjustment of the connection point via a releasable set screw or wing bolt which locks the clamp against brace 2. This also provides a convenient means to fully disengage the stabilizers. When the clamp is moved to its maximum vertical position, it holds the brace and arm parallel against the side of the rail.

To permit complete folding, the stabilizer on one side of the ladder must be mounted offset with respect to the second stabilizer by about the thickness of the second stabilizer, in a direction forward and normal to the plane of the front of the ladder when the stabilizers are folded. One way this can be accomplished is shown in FIGS. 11–12, using offset mounting brackets. These figures are top views of the lower left hinge of FIGS. 1–3. For this purpose, offset brackets or connectors, shims, or offset hinge plates can be used, or the hinge axes can can be located farther forwared on one side of the ladder.

A catch, clip, hook, or the like should be provided to releasably hold the stabilizers in the folded position. This releasably connects the folded stabilizers together at a crossing point, or connects the outer stabilizer to a step at a crossing point.

PREFERRED EMBODIMENT

Each embodiment shown has its advantages. For the sake of simplicity, flexibility, and inexpensive yet sturdy construction, embodiment 1, of FIGS. 1–3, is preferred. It should have the enhancements of FIGS. 10–12. This allows adaptability for installation on any ladder, and disengagement for use of the ladder beside an obstruction.

OPERATION

The usual operation is to set-up the ladder, then simply unfold the stabilizers, rotating them to the sides until they contact the ground. The ladder is then used as normal. To move it, the stabilizers are refolded.

If a side of the ladder is obstructed, the stabilizer on that side can be left folded, especially with embodiments 2 and 3 (FIGS. 6–9). With embodiment 1, the foot can be retracted, and the unused stabilizer rotated against the side of the ladder, out of the way.

For extended periods of obstructed use, an unused stabilizer of embodiment 1 can be collapsed and kept out of the way beside the rail by moving the swivel clamp 10 to its higheset position.

Installing the stabilizers comprises attaching the hinges to the rails of a ladder with bolts. To mark the attachment points, a stabilizer is held in the folded position with its foot touching, or slightly above, the ground. If an extendable arm is provided, its length is adjusted, prior to marking the attachement positions, so that the stabilizer foot reaches the opposite rail when folded.

I claim:

1. In combination with a portable ladder having steps attached to rails, an improvement for stabilizing said ladder, wherein the improvement comprises:

an elongated rigid brace;
an elongated rigid arm;
a first and second hinge;
one end of said brace attached to said first hinge;
one end of said arm attached to said second hinge, and the other end attached to said brace; and
said hinge attached to a rail of said ladder, with hinge axes approximately parallel to said rail and spaced from said rail to provide a range of hinge rotation greater than 180 degrees.

2. The improvement of claim 1 wherein said arm is attached to said brace using a hinge-clamp means for adjusting the attachment point on said brace, comprising hardware with clamping means for attachment to the end of said arm; releasable clamping means for attachment to a range of positions on said brace; and hinge means for variable angular connection between the two said clamping means of said hardware.

3. The improvement of claim 1, further including an extendable foot on the lower end of said brace, with adjustment means for extending and retracting said foot relative to said brace.

4. The improvement of claim 1, further including extension means for adjusting the length of said arm.

5. In combination with a portable ladder having steps attached to rails, an improvement for stabilizing said ladder, wherein the improvement comprises:

a generally L-shaped rigid member;
a first and second hinge;
said hinges attached near each end of the long side of said L member, withh hinge axes approximately parallel with said long side; and
said hinges attached to a rail of said ladder, with hinge axes approximately parallel to said rail and spaced from said rail to provide a range of hinge rotation greater than 180 degrees.

6. In combination with a portable ladder having steps attached to rails, an improvement for stabilizing said ladder, wherein the improvement comprises:

an elongated rigid brace;
two elongated rigid arms;
a hinge attached to one end of each arm;
the other end of each arm attached to said brace;
said hinges attached to a rail of said ladder, with hinge axes approximately parallel to said rail and spaced from said rail to provide a range of hinge rotation greater than 180 degrees.

* * * * *